US006840511B1

(12) United States Patent
Hung

(10) Patent No.: US 6,840,511 B1
(45) Date of Patent: Jan. 11, 2005

(54) INDICATION STRUCTURE FOR PAPER RESERVES ADAPTED FOR AUTO DOCUMENT FEED APPARATUS

(75) Inventor: Ming-Te Hung, Taipei (TW)

(73) Assignee: Lite-On Technology Corporation, Taipei (TW)

( * ) Notice: Subject to any disclaimer, the term of this patent is extended or adjusted under 35 U.S.C. 154(b) by 0 days.

(21) Appl. No.: 10/613,047

(22) Filed: Jul. 7, 2003

(51) Int. Cl.[7] ..... B65H 1/00
(52) U.S. Cl. ..... 271/145; 271/147
(58) Field of Search ..... 271/145, 147; 221/6

(56) References Cited

U.S. PATENT DOCUMENTS 3,260,402 A * 7/1966 Lareau et al. ..... 221/4
5,053,814 A * 10/1991 Takano et al. ..... 399/23
5,236,348 A * 8/1993 Fetherolf et al. ..... 400/703
5,273,271 A * 12/1993 Intemann ..... 271/145
5,700,003 A * 12/1997 Sung ..... 271/110

* cited by examiner

*Primary Examiner*—David H. Bollinger
(74) *Attorney, Agent, or Firm*—Birch, Stewart, Kolasch & Birch, LLP

(57) ABSTRACT

An indication structure for paper reserves adapted for auto document feed apparatus includes a housing, a feed module, a printer module, a support element, an elasticity element, a light source, a shield element and a transparent element; wherein, the shield element is arranged on a radiation path of the light source, to shield the part of light, the transparent element is mounted in an opening of the housing, for providing the light radiated out. Whereby, using the simple structure to improve higher manufactured cost, processes and longer time of fabrication.

14 Claims, 4 Drawing Sheets

INDICATION STRUCTURE FOR PAPER RESERVES ADAPTED FOR AUTO DOCUMENT FEED APPARATUS

BACKGROUND OF THE INVENTION

1. Field of the Invention

The present invention relates to an indication structure for paper reserves, and in particular to an indication structure for paper reserves for use in an auto document feed apparatus that can provide an indication of paper reserves.

2. Description of the Prior Art

Following the upgraded rapidly of the industry, and the times of knowledge economic coming, such that the people using paper, files and messages in writing, which dealing with each other is more frequently; each type of the printers, copier, fax machines or other auto document feed apparatuses has been the major product for modern. Therefore, high added value, high resolution, light, low cost and fabrication convenience has been a major index for choosing.

Reference is made to FIG. 1, which illustrates an indication structure for paper reserves. The indication structure is adapted for use in accord with the prior art printers, copywriters, fax machines or auto document feed apparatuses. The indication structure for paper reserves has a support plate 11*a* for receiving paper. Support plate 11*a* contacts a spring 12*a*. The bottom of the support plate 11*a* has a hook 13*a*. The indication structure for paper reserves has a cord 1*a* and cord 1*a* has a first end and a second end, of which the first end links to the hook 13*a*. A support shaft 2*a* connects to a housing 14*a* of the auto document feed apparatus to allow the cord 1*a* to slide thereon. A slide 3*a* links to the second end of the cord 1*a* and slide 3*a* has a paper reserves indication pin 31*a* thereon to indicate the paper reserves. A guide shaft 4*a* is vertically arranged on the housing 14*a* of the auto document feed apparatus to allow the slide 3*a* to slide thereon. Support plate 1*a* compresses spring 12*a* and influences cord 1*a* to make slide 3*a* slide on the guide shaft 4*a* when the paper reserves in the support plate 11*a* of the auto document feed apparatus are high. As paper reserves decrease, the support plate 11*a* move gradually upward due to a force of the spring 3*a*, thereby causing the paper reserves indication pin 31*a* to indicate the amount of paper reserves.

Reference is made to FIG. 2, in which another indication structure for paper reserves adapted for auto document feed apparatus is illustrated in accord with the prior art. The indication structure for paper reserves has a support plate 1*a*' for receiving paper and a lead screw 2*a*' contacts the bottom of the support plate 1*a*' to provide the support plate 1*a*' for displacement upward or downward. A drive motor 3*a*' is located on a side of the lead screw 2*a*', the drive motor has at least one gear, to provide the lead screw 2*a*' rotationally contacted therewith. A sensor 4*a*' is located on a top side of the support plate 1*a*' to provide pressure measurement. A feedback signal control module for drive motor 5*a*' contacts the drive motor 3*a*' or the sensor 4*a*' electrically. Thereby, a program design of the feedback signal control module for drive motor 5*a*' controls, while the paper do not reach the prediction high of paper, then paper do not touch the pressure sensor 4*a*', at the same time the sensor 4*a*' provides an electrical signal for the feedback signal control module for drive motor 5*a*', (it is) dealt by the program design of the feedback signal control module for drive motor 5*a*', to output a electrical signal to the drive motor 3*a*' which driven the lead screw 2*a*' to generate a displacement upward, making the paper arranges on the support plate 1*a*' to reach and touch the pressure sensor 4*a*', so that using the sensor 4*a*' to detect the variation of the paper reserves, providing a electrical signal for the feedback signal control module for drive motor 5*a*', dealt by the program design of the feedback signal control module for drive motor 5*a*', to output a prediction known ideal value signal to the drive motor 3*a*', thereby, to reach the purpose of automatic detecting paper reserves.

Moreover, the taught indication structure for paper reserves adapted for auto document feed apparatus as above description, (it is) providing a function of the paper reserves for showing or detecting, however, due to some manufacture technology limitations, more work pieces cause to be restricted of manufactured cost and fabrication on production line, and the mechanical complexity increases, too. Thereof, the qualities of taught manufacture technology limitations, so that the indication structure for paper reserves adapted for auto document feed apparatus can not be easily fabricated and fast maintained, thus the manufactured cost will be also increased.

Following the upgraded rapidly of the industry, such that the life of humans is also changed; fast, convenient, easy, light, handy and cheap is a code word of the modern. However, the taught indication structure for paper reserves adapted for auto document feed apparatus is unfavorable to repair, replace and maintain. Simultaneously, the manufactured cost and the difficulty of fabrication are increased, too. Today the requirements of indication structure for paper reserves adapted for auto document feed apparatus known in the prior art could not be reached.

Further, in according to the Kennedy's theorem or the Grashof's theorem of the Mechanical Engineering, we know that a multi-bar linkage system (generally above four-bar linkage) often has a plurality of instantaneous center or multi-degree of freedom thereon. Consequently, requires the higher precision for fabricating or arranging the mechanical system, the manufactured cost and the difficulty of fabrication increases, too.

Accordingly, as above description we knowing the indication structure for paper reserves adapted for auto document feed apparatus known in the prior art having exists a non-convenience and defect in using practically.

Therefore, the present invention is directed to an improved the indication structure for paper reserves adapted for auto document feed apparatus with the inventor's research hardly and the application of theorem having a reasonable design and lower manufactured cost thereon.

SUMMARY OF THE DISCLOSURE

It is an object of the present invention to provide an indication structure for paper reserves adapted for auto document feed apparatus, for achieving the function of indicating paper reserves with more simplistic, and further corresponds to the micro scale trend, thereby decrease the cost of fabrication and manufacture.

In order to achieve the above objective of the invention that providing an indication structure for paper reserves adapted for auto document feed apparatus having a housing, at least one opening arranged thereon, a support element received in the housing, an elasticity element fixedly positioned between the housing and the support element, to contact with the support element elastically, a feed module received in the housing, to convey or deliver paper; the indication structure for paper reserves is comprising: a light source received in the housing to radiate light; and a shield element arranged on a radiation path of the light source, to shield the part of light.

In the cause of examiner or judge can further knowing in other objects, feathers and technological subject matters of the invention will be apparent from the following detailed description taken in connection with the accompanying drawings. However, the present examples and embodiments are to be considered in all respects as illustrative and not restrictive, and the invention is not to be limited to the details given herein.

BRIEF DESCRIPTIONS OF THE DRAWINGS

The present invention can be fully understood from the following detailed description and preferred embodiment with reference to the accompanying drawings in which.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Although the embodiments of the present invention are described below in connection with an indication structure for paper reserves adapted for auto document feed apparatus, the present invention can be applied to all auto document feed apparatus, including but not limited to auto document feed devices, printers, copy writers, fax machines, as well as all other auto document feed apparatus and feed paper machines.

Figure 1:
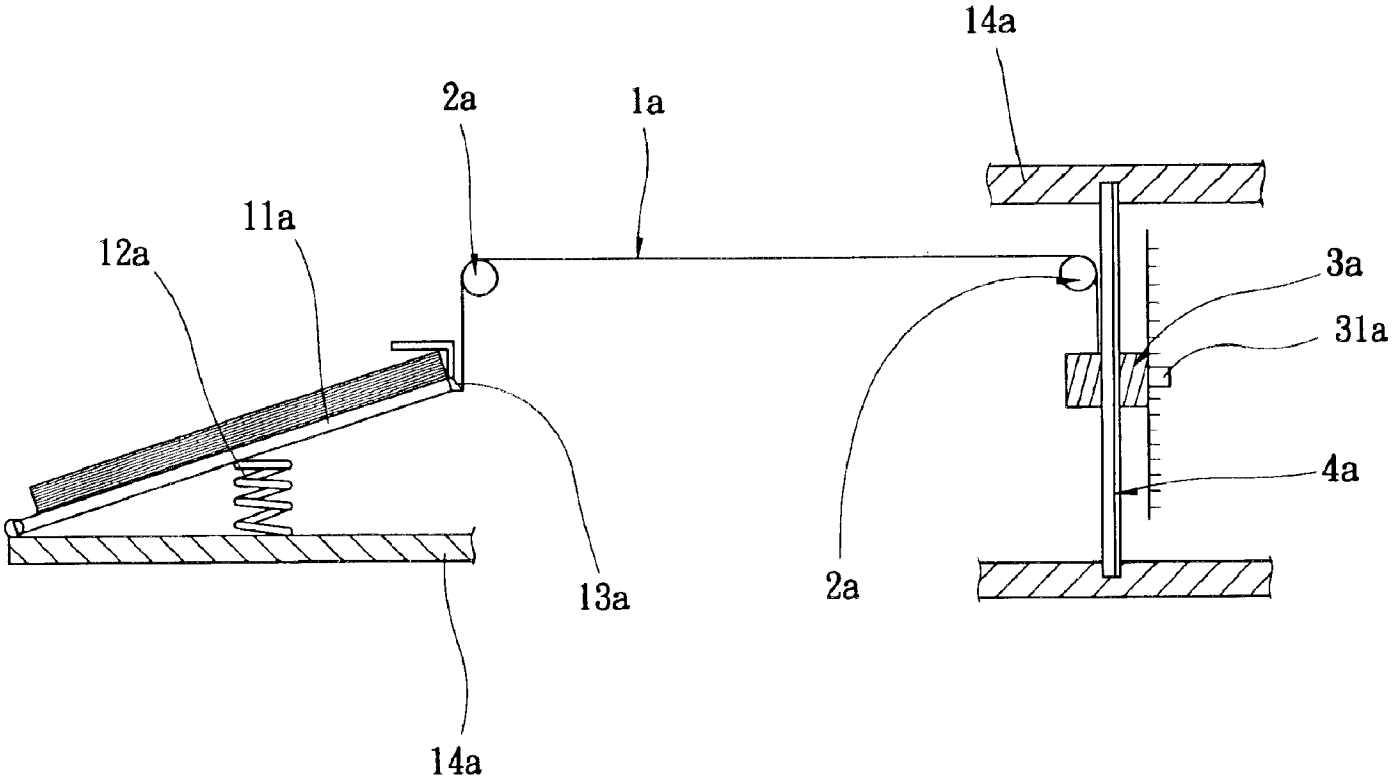
FIG. 1 PRIOR ART
FIG. 1 is a perspective view of a conventional indication structure for paper reserves adapted for auto document feed apparatus.
Figure 2:
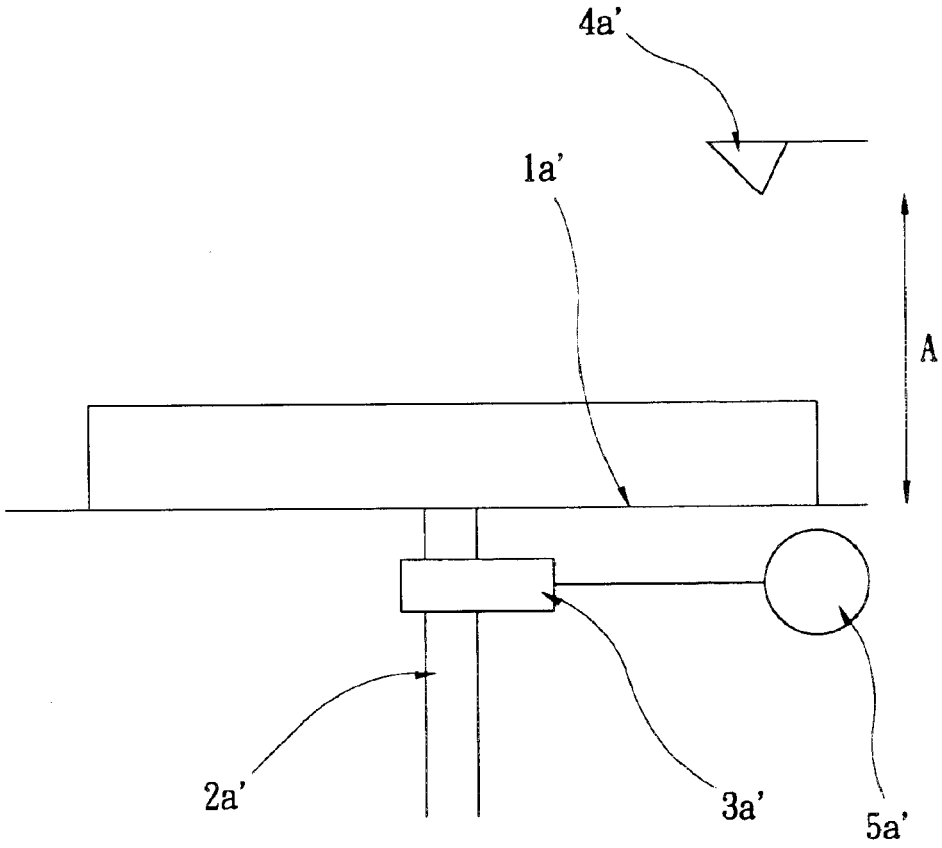
FIG. 2 PRIOR ART
FIG. 2 is a perspective view of another conventional indication structure for paper reserves adapted for auto document feed apparatus.
Figure 3:
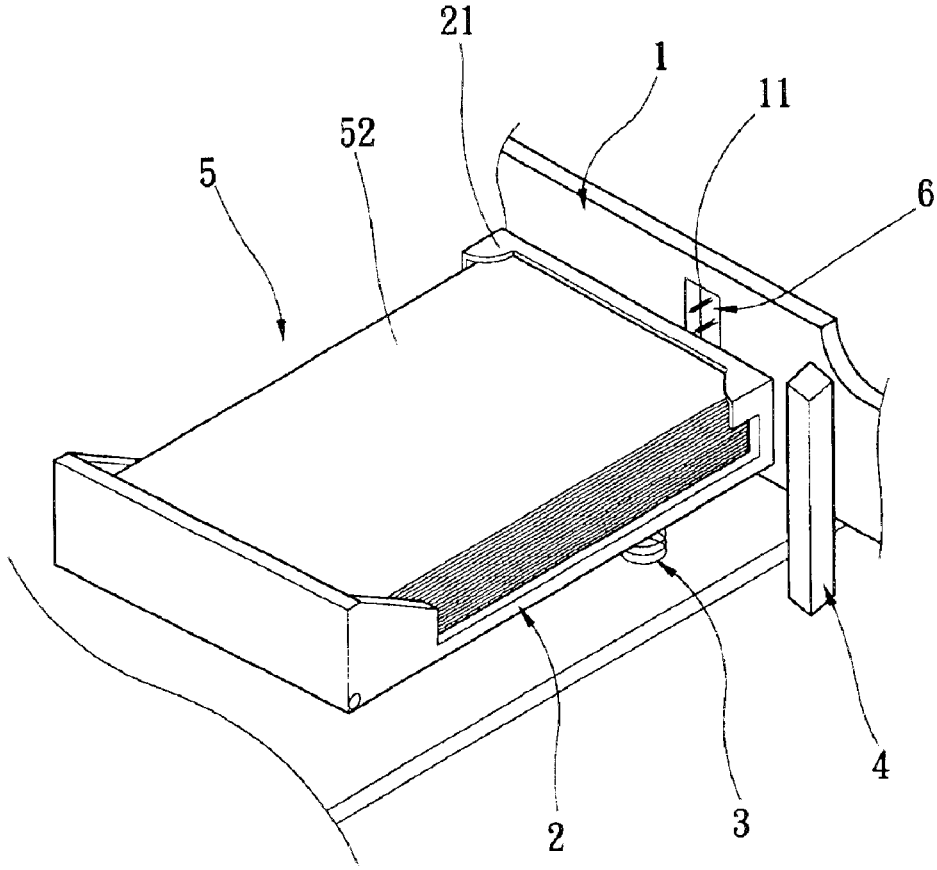
FIG. 3 is a perspective view according to an embodiment of the present invention.

Please refer to FIG. 3 illustrates an indication structure for paper reserves adapted for auto document feed apparatus, wherein the auto document feed apparatus has a housing 1, at least one opening 11 is arranged thereon, a support element 2 is received in the housing 1, for receiving paper therein, a side of the support element 2 pivotally connects to the housing 1, for providing the support element 2 vibration on the pivotal portion; an elasticity element 3 is a spring or a spring band fixedly positioned between the housing 1 and the support element 2, to contact with the support element 2 elastically, it is providing a suitable elasticity for the support element 2; a hamper 21 protrudes from the top side of support element 2, to withstand the paper on the support element 2, (it is) for providing a reaction force, which is equal to an elasticity force generated by the spring 3. A feed module (not shown) is received in the housing 1, to convey or deliver paper; a printer module (not shown) is arranged on the paper output of the feed module for printing.

The indication structure for paper reserves includes a light source 4 which is a light emitting diode (LED), (it is) received in the housing 1 to radiate light; and a shield element 5 is paper 52 on the support element 2, which is arranged on a radiation path of the light source 4, to shield a part of light, whereby the paper reserves are indicated though the light obvious from the opening 11; a transparent element 6 on which the opening 11 of the housing 1 is mounted for observing; the transparent element 6 is a piece of optical transparent plastic or optical glass, which is arranged on the radiation path of paper 52. The transparent element 6 has an observation line or a notch thereon for observing conveniently, thereby, users can directly and exactly observe from outside of the housing 1, to know the paper reserves in the auto document feed apparatus.

Figure 4:
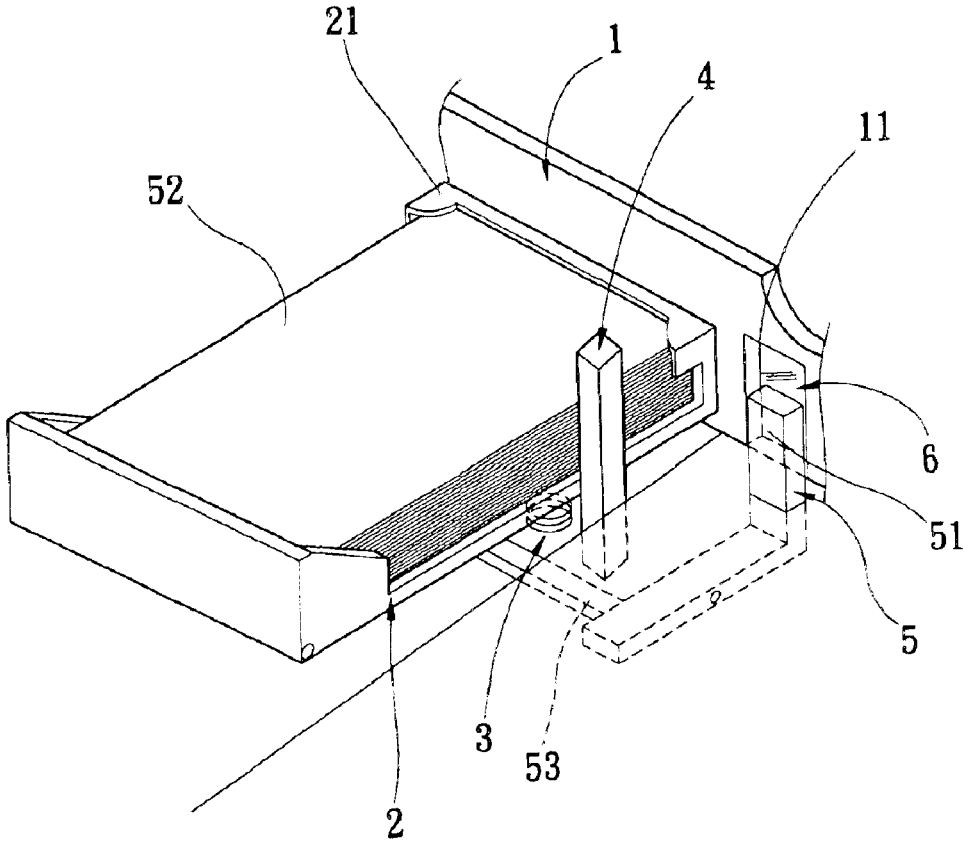
FIG. 4 is a perspective view according to another embodiment of the present invention.

Please refer to FIG. 4 illustrates another indication structure for paper reserves adapted for auto document feed apparatus, wherein the indication structure for paper reserves includes a light source 4 which is a light emitting diode (LED), (it is) received in the housing 1 to radiate light; and a shield element 5 is a plate 51 with a protrusion 53, the protrusion 53 extends from the bottom of the plate 51, to contact with the support element 2; the protrusion 53 further having a pivot (not shown) thereon is pivotally connected with the housing 1, while the paper 52 increases on the support element 2, the support element 2 generates a displacement downwardly, to pressure aside of the protrusion 53 indirectly, that is providing a function of lever for the plate 51, making the plate 51 moved upwardly, Moreover, while the paper 52 decreases on the support element 2, then the plate 51 moves downwardly; the plate 51 is arranged on a radiation path of the light source 4, to shield the part of light; a transparent element 6 on which the opening 11 of the housing 1 is mounted for observing; the transparent element 6 is a piece of optical transparent plastic or optical glass, which is arranged on the radiation path of the plate 51. The transparent element 6 has an observation line or a notch thereon for observing conveniently, thereby, users can directly and exactly observe from outside of the housing 1, to know the paper reserves in the auto document feed apparatus.

A prototype of positioning structure of roller adapted for auto document feed apparatus has been constructed herein with feathers as above descriptions, the present invention is using the most simplistic mechanical structure, decreasing the manufactured cost and time of fabrication substantially, to increase the convenience for using, fabrication and repair; wherein, using the light emitting diode (LED) has the properties of emission light, convenience to users directly or indirectly observes to know the paper reserves. Simultaneously, the present invention eliminates and saves more mechanical structures or elements then the conventional multi-bar linkage mechanical apparatus and obtains the equality function or even better, and saves more space. So that the present invention improves the defect of the known indication structure for paper reserves adapted for auto document feed apparatus in prior art that cannot effectively decrease higher manufactured cost and longer time of fabrication and maintainability, moreover, the present invention also reduces the volume of the indication structure for paper reserves to correspond with the fashion of modern.

Although particular embodiment of the invention has been described in detail for purpose of illustration, various modifications and enhancements maybe made without departing from the spirit and scope of the invention. Accordingly, the invention is not to be limited except as by the appended claims.

What is claimed is:

1. An indication structure for paper reserves adapted for an auto document feed apparatus having a housing, at least one opening arranged thereon, a support element received in the housing, an elasticity element fixedly positioned between the housing and the support element, to contact with the support element elastically; the indication structure for paper reserves, comprising:

a light source received in the housing to radiate light; and a shield element arranged on a radiation path of the light source to shield a part of the light;

whereby the paper reserves are indicated though the light obvious from the opening.

2. The indication structure as claimed in claim 1, wherein the light source is a light emitting diode (LED).

3. The indication structure as claimed in claim 1, wherein the shield element is the paper.

4. The indication structure as claimed in claim 1, wherein the shield element is a non-transparent element.

5. The indication structure as claimed in claim 4, wherein the non-transparent element is a plate with a protrusion to contact with the support element.

6. The indication structure as claimed in claim 1, further comprising a transparent element is mounted on opening for observing.

7. The indication structure as claimed in claim 6, wherein the transparent element is a piece of optical transparent plastic or optical glass.

8. An indication structure for paper reserves adapted for an auto document feed apparatus, comprising:

a light source received in a housing of the auto document feed apparatus to radiate light; and a shield element arranged on a radiation path of the light source to shield a part of the light;

whereby the paper reserves are indicated though the light obvious from an opening on the housing.

9. The indication structure as claimed in claim 8, wherein the light source is a light emitting diode (LED).

10. The indication structure as claimed in claim 8, wherein the shield element is paper.

11. The indication structure as claimed in claim 8, wherein the shield element is a non-transparent element.

12. The indication structure as claimed in claim 11, wherein the non-transparent element is a plate with a protrusion to contact with a support element received in the housing.

13. The indication structure as claimed in claim 8, further comprising a transparent element mounted on the opening of the housing for observing.

14. The indication structure as claimed in claim 13, wherein the transparent element is a piece of optical transparent plastic or optical glass.

* * * * *